United States Patent [19]

Takano

[11] Patent Number: 5,046,956

[45] Date of Patent: Sep. 10, 1991

[54] ELECTRICAL CONNECTOR DEVICE

[75] Inventor: Tsunesuke Takano, Tokyo, Japan

[73] Assignee: Kabushiki Kaisha T AN T, Tokyo, Japan

[21] Appl. No.: 525,716

[22] Filed: May 21, 1990

[30] Foreign Application Priority Data

May 30, 1989 [JP] Japan ..... 1-63118[U]
May 30, 1989 [JP] Japan ..... 1-63119[U]

[51] Int. Cl.[5] ..... H01R 9/09

[52] U.S. Cl. ..... 439/78; 439/553; 439/557

[58] Field of Search ..... 439/55, 76, 78, 553, 439/554, 557, 567, 568, 571, 572

[56] References Cited

U.S. PATENT DOCUMENTS

| | | | |
|---|---|---|---|
| 4,124,267 | 11/1978 | Mines et al. | 439/553 |
| 4,255,005 | 3/1981 | Fukunaga | 439/571 X |
| 4,527,849 | 7/1985 | Marach | 439/571 X |
| 4,603,930 | 8/1986 | Ito | 439/78 |
| 4,668,040 | 5/1987 | Matsuzaki et al. | 439/571 |
| 4,684,198 | 8/1987 | Becraft et al. | 439/571 |
| 4,894,018 | 1/1990 | Phillips et al. | 439/78 X |

FOREIGN PATENT DOCUMENTS 58-10306 2/1983 Japan .

*Primary Examiner*—Neil Abrams
*Assistant Examiner*—Khiem Nguyen
*Attorney, Agent, or Firm*—Nixon & Vanderhye

[57] ABSTRACT

An electrical connector device has elongated narrow conductor plates provided on one side of an insulating base made of plastic, the conductor plates being bent upward so as to provide upwardly projecting conductor strips. The device also has a tubular insulating member having a bottom provided with apertures for receiving the conductor strips. Structures are provided on the insulating base and the tubular insulating member for fastening the tubular insulating member to the insulating base by a single snap fit action. The device further has a male engaging member having female connector members adapted to fit on the conductor strips. When the tubular insulating member is fixed to the insulating base, the base portions of the conductor strips are clamped between the portions of the lower surface of the bottom of the tubular insulating member around the apertures and the surface of the insulating base.

5 Claims, 11 Drawing Sheets

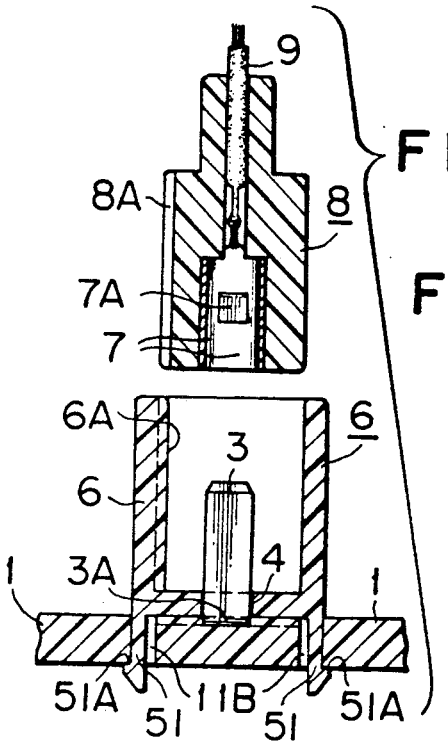
FIG. 4A
FIG. 4B
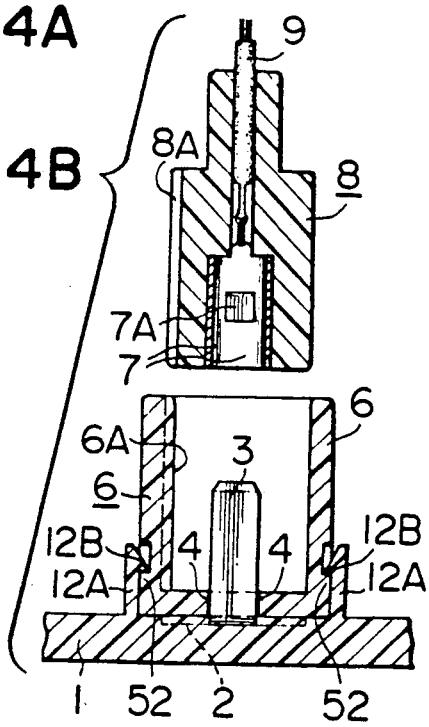
FIG. 5A
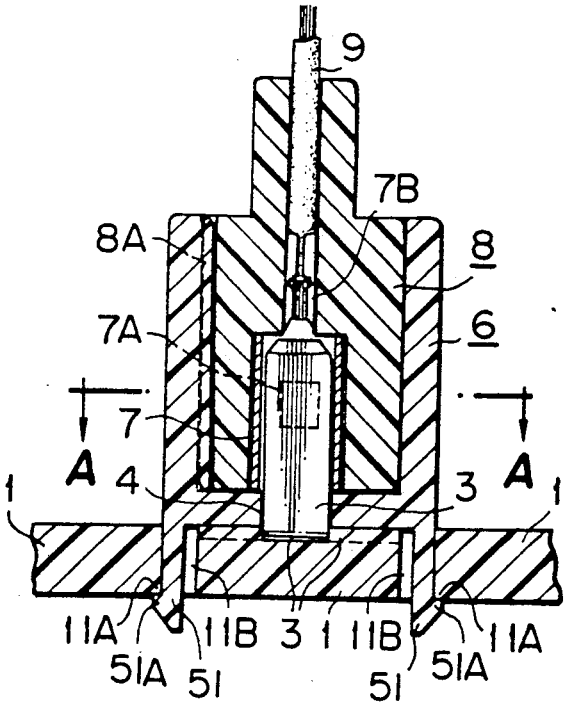
FIG. 5B
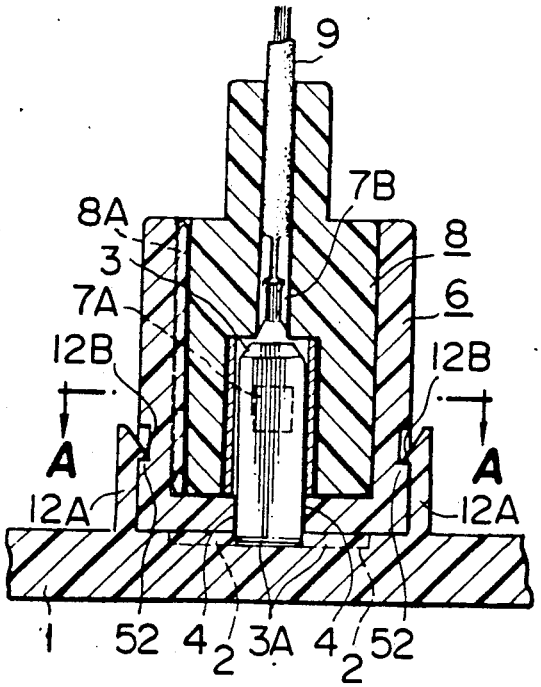

ELECTRICAL CONNECTOR DEVICE

BACKGROUND OF THE INVENTION

1. Field of the invention

The present invention relates to an electrical connector device and, more particularly, to an electrical connector device in which the base portions of conductor strips are bent from a narrow conductor strip ( generally referred to as BUS bar ) and are firmly fixed by apertures formed in the bottom of a tubular insulating member. More specifically, the bus bar is immobilized between the bottom surface of the tubular insulating member and the surface of an insulating base member so as to prevent the tabs from being deformed or displaced by an external force.

2. Description of the related art

Japanese Utility Model Examined Publication No. 58-10306 discloses a connector housing used with an electrical connector device generally of the type mentioned above.

This known connector housing accommodates a plurality of female bi-polar terminals which fit at their one end on a plurality of parallel male terminals. The connector housing has a frame which opens at its upper and lower ends. Partition walls extending perpendicularly to the longitudinal walls of the frames are provided in the frame so as to define a plurality of terminal receiving chambers. Tapered guide surfaces are formed on the lower ends of the left and right side walls and the partition walls. The lower ends of the partition walls are positioned out of alignment with the opening at the lower end of the frame.

In use, a separately prepared cover plate having a central bore is fastened by screws to a circuit board in such a manner that a flange radially extending from a lower portion of the frame is pressed by the portion of the cover plate around the central bore, whereby the housing is fixed to the circuit board.

Thus, the known connector housing requires a separate cover plate, which makes the administration of parts difficult and raised the cost of the connector. Furthermore, fastening of the cover plate with screws is quite laborious particularly in a dark place or when the space is restricted. In addition, it is necessary to use a special tool such as a screw driver.

In this known connector housing, it is impossible to fix the base portions of strips which are bent upward from BUS bars by the lower surface of the housing. Namely, the arrangement is such that the upper surface of the circuit board is pressed at a portion spaced apart from the above-mentioned base portions of the strips by the lower end of the tapered inner surface of the flange provided on the housing. Therefore, the strips are liable to be deformed or displaced by an external force.

SUMMARY OF THE INVENTION

Accordingly, a first object of the present invention is to provide an electrical connector device in which the base portions of strips upwardly bent from BUS bars provided on an insulating base are pressed onto the surface of the insulating base by means of strip-receiving apertures formed in the bottom of a tubular insulating member and also by the lower face of the bottom of the tubular insulating member, so as to prevent deformation or displacement of the strips, while resilient tabs formed on the tubular insulating member are inserted into the aperture formed in the insulating base so as to engage with the lower edges of the aperture so that the connector can be fixed without requiring a cover plate and screws, thus overcoming the above-described problems of the prior art.

A second object of the present invention is to provide an electrical connector device in which the base portions of strips upwardly bent from BUS bars provided on an insulating base are pressed onto the surface of the insulating base by means of strip-receiving apertures formed in the bottom of a tubular insulating member and also by the lower face of the bottom of the tubular insulating member, so as to prevent deformation or displacement of the strips, while resilient tabs formed on the insulating base engage with retaining steps formed on the tubular insulating member so that the connector can be fixed without requiring a cover plate and screws, thus overcoming the above-described problems of the prior art.

To achieve the first object, the present invention in its first aspect provides an electrical connector device comprising: elongated narrow conductor plates provided on one side of an insulating base made of a plastic, the conductor plates being bent upward so as to provide upwardly projecting conductor strips; a tubular insulating member having a bottom provided with apertures for receiving the conductor strips, the tubular insulating member also having resilient tabs capable of engaging with lower edges of the insulating base; and a male engaging member having female connector members adapted to fit on the conductor strips; wherein the base portions of the conductor strips are clamped between the portions of the lower surface of the bottom of the tubular insulating member around the apertures and the surface of the insulating base.

To achieve the second object, the present invention in its second aspect provides an electrical connector device comprising: elongated narrow conductor plates provided on one side of an insulating base made of a plastic, the conductor plates being bent upward so as to provide upwardly projecting conductor strips; the insulating base having resilient tabs projecting upward therefrom; a tubular insulating member having a bottom provided with apertures for receiving the conductor strips, the tubular insulating member also having retaining steps capable of retaining the resilient tabs of the insulating base; and a male engaging member having female connector members adapted to fit on the conductor strips; wherein the base portions of the conductor strips are clamped between the portions of the lower surface of the bottom of the tubular insulating member around the apertures and the surface of the insulating base.

According to the first aspect of the present invention, the base portions of the conductor strips upwardly bent from BUS bars are strongly clamped between the upper surface of the insulating base and the lower surface of the bottom of the tubular insulating member around the apertures, as a result of the engagement between the resilient tabs of the tubular insulating member and the edges of the insulating base, so that unintentional deformation or displacement of the conductor strips is prevented despite application of an external force which is exerted when, for example, the female connector members are brought into or out of contact with the conductor strips. In addition, the tubular insulating member can be fastened by a snap fit without requiring a cover plate and a tool, by virtue of the engagement between the resilient tabs and the edges of the insulating base.

According to the second aspect of the present invention, the base portions of the conductor strips upwardly bent from BUS bars are strongly clamped between the upper surface of the insulating base and the lower surface of the bottom of the tubular insulating member around the apertures, as a result of the engagement between the resilient tabs of the tubular insulating member and the edges of the insulating base, so that unintentional deformation or displacement of the conductor strips is prevented despite application of an external force which is exerted when, for example, the female connector members are brought into or out of contact with the conductor strips. In addition, the tubular insulating member can be fastened by a snap fit without requiring a cover plate and a tool, by virtue of the engagement between the resilient tabs on the insulating base and the retaining steps on the tubular insulating member.

These and other objects, features and advantages of the present invention will become clear from the following description when the same is read in conjunction with the accompanying drawings.

BRIEF DESCRIPTION OF THE DRAWINGS

FIGS. 4A and 4B are vertical sectional views of the first and the second embodiments;

FIGS. 5A and 5B are vertical sectional views of the first and the second embodiments, respectively, with the male engaging member inserted into the tubular insulating member;

DESCRIPTION OF THE PREFERRED EMBODIMENTS

A first embodiment will be described with reference to the drawings.

Figure 1A:
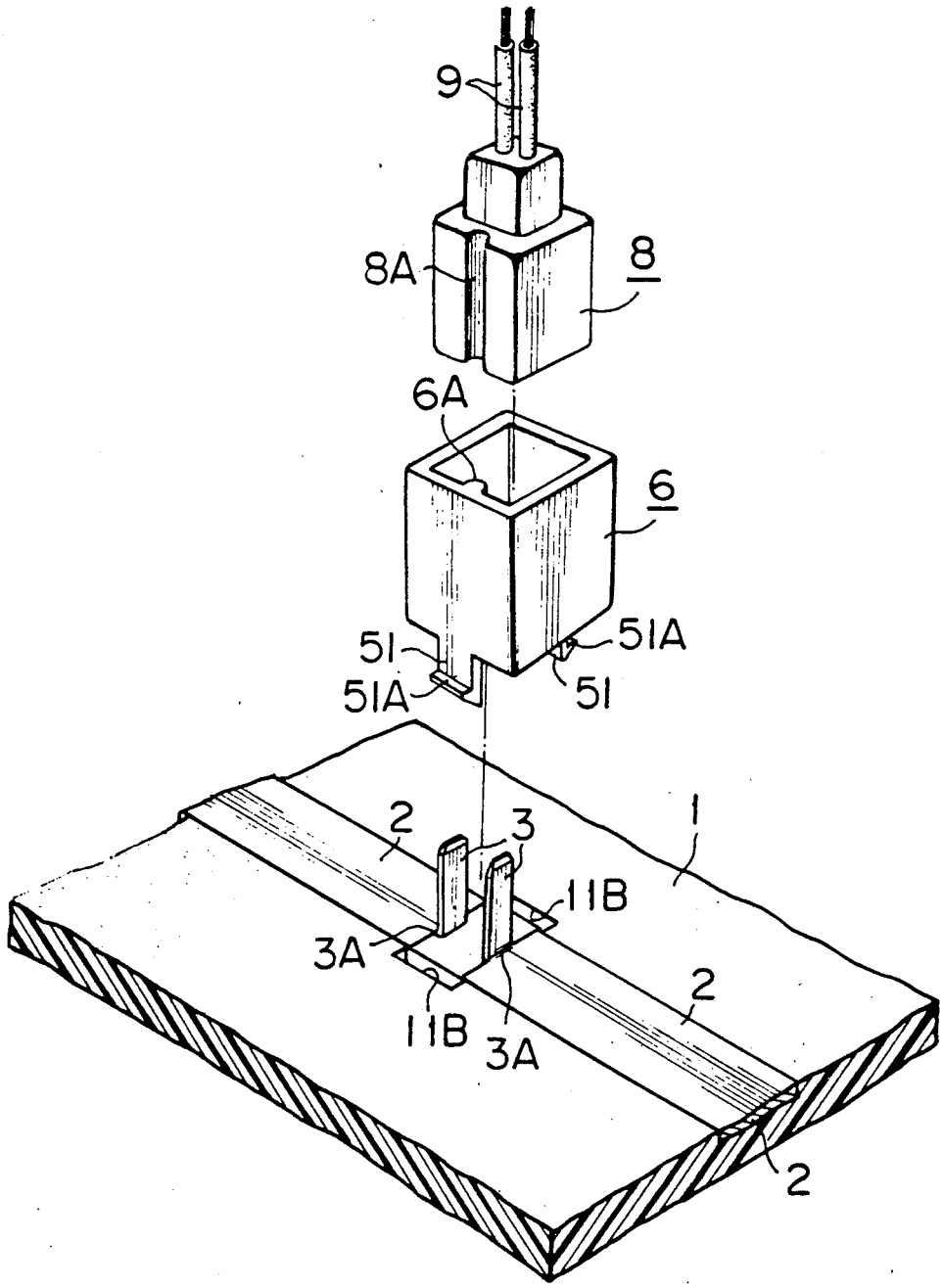
FIG. 1A and FIG. 1B are exploded perspective views of the first and the second embodiments of the invention, respectively, wherein an insulating base, a tubular insulating member and a male engaging member are separated from one another.
Figure 2B:
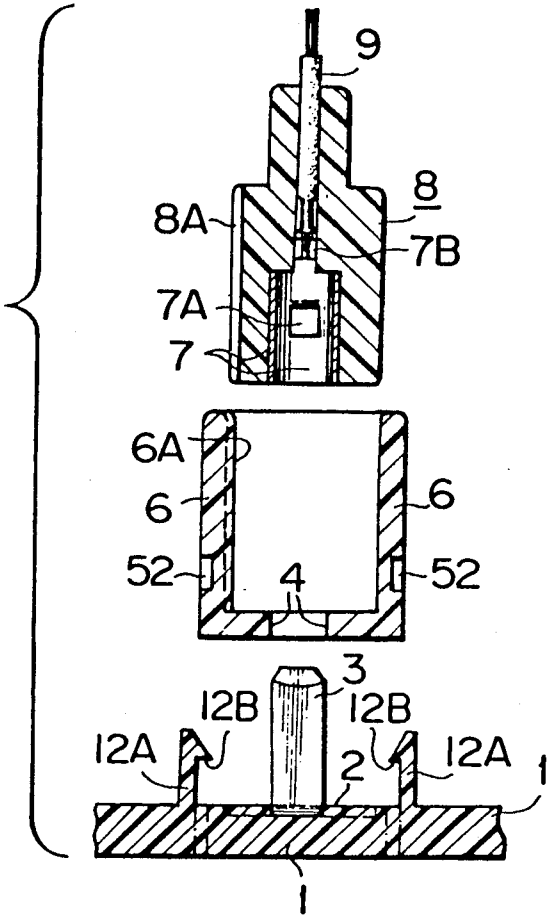
FIGS. 2A and 2B are vertical sectional views of the first and the second embodiments of the invention, respectively.
Figure 2A:
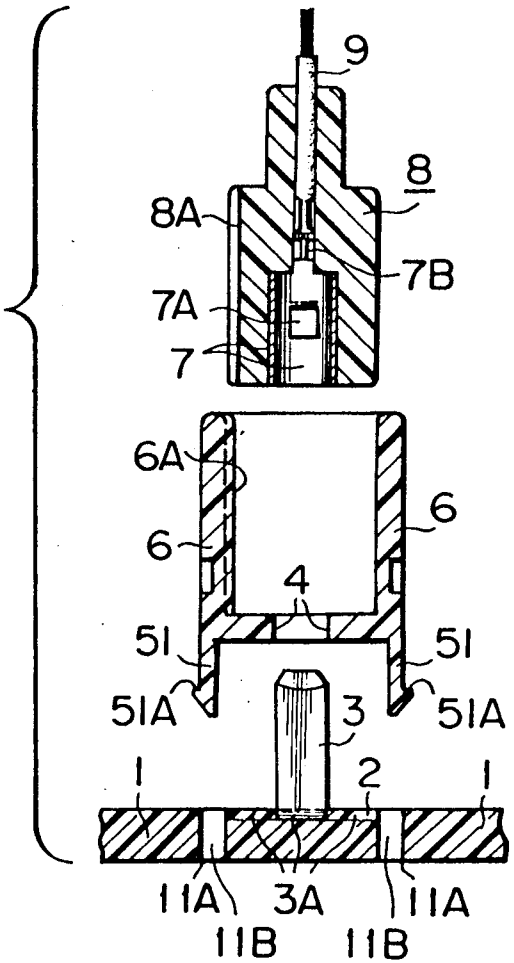
Figure 3A:
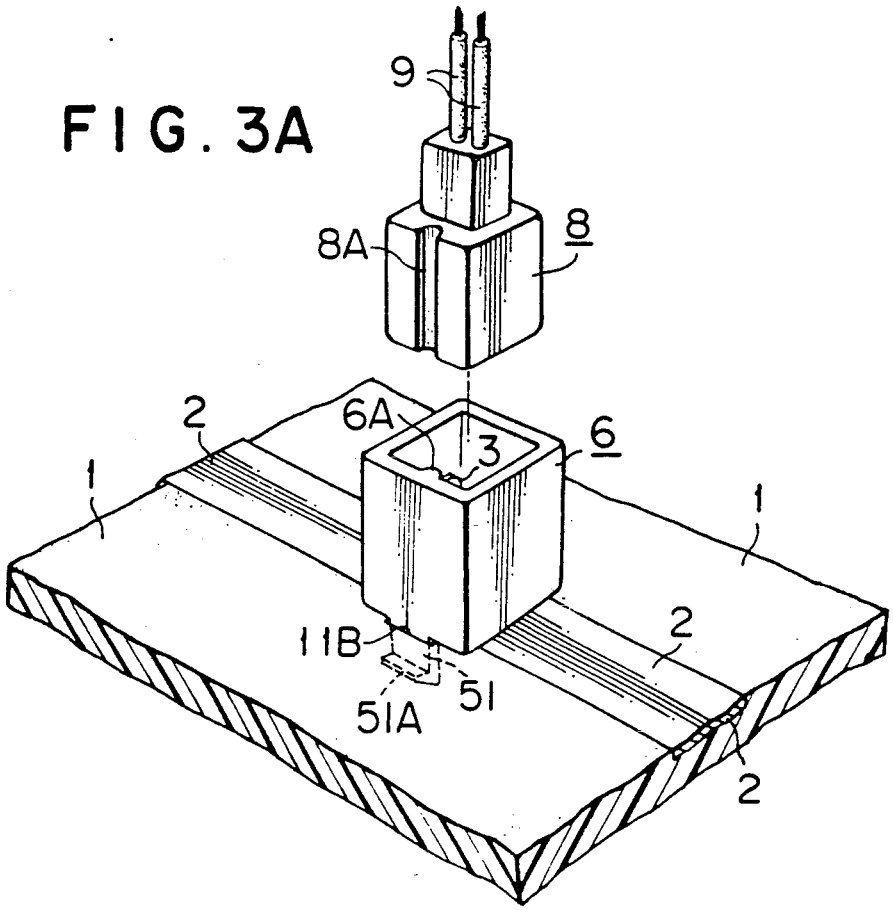
FIGS. 3A and 3B are perspective views of the first and the second embodiments of the invention, respectively, wherein the tubular insulating member is fitted to the insulating base.
Figure 7B:
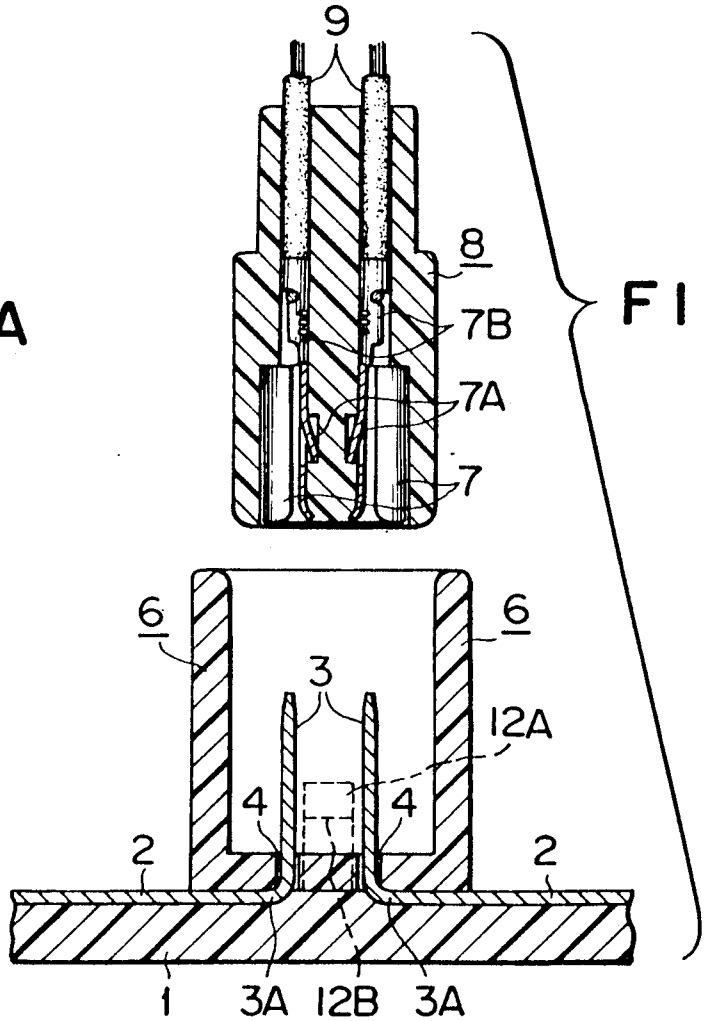
FIGS. 7A and 7B are vertical sectional views of the first and the second embodiments, taken at different planes from the vertical sectional views in FIGS. 4A and 4B.
Figure 7A:
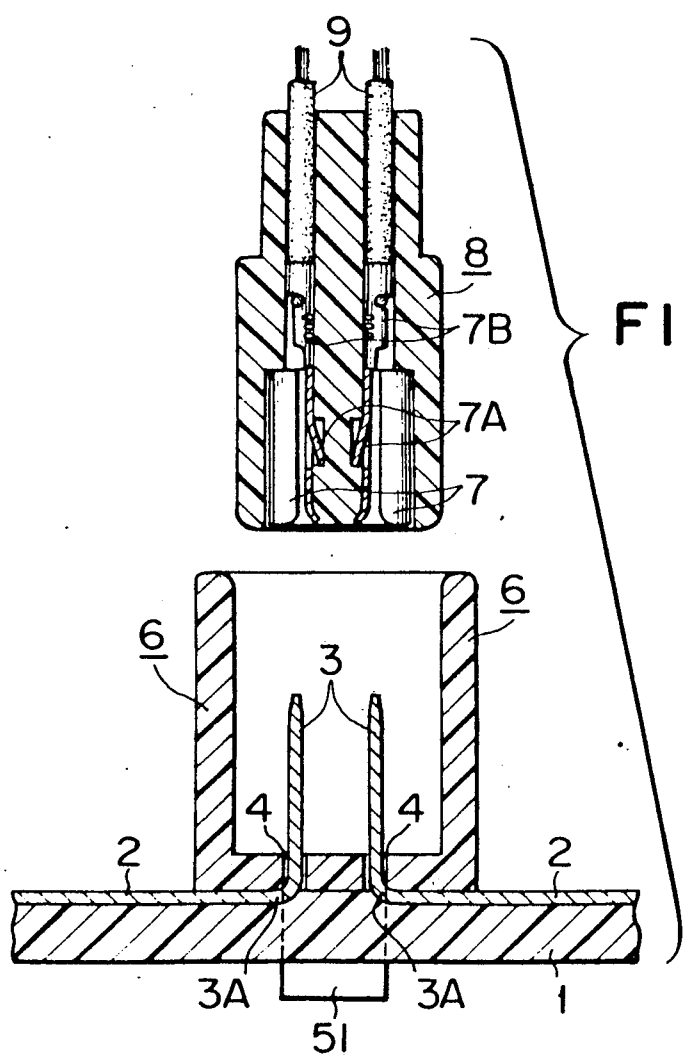
Figure 8A:
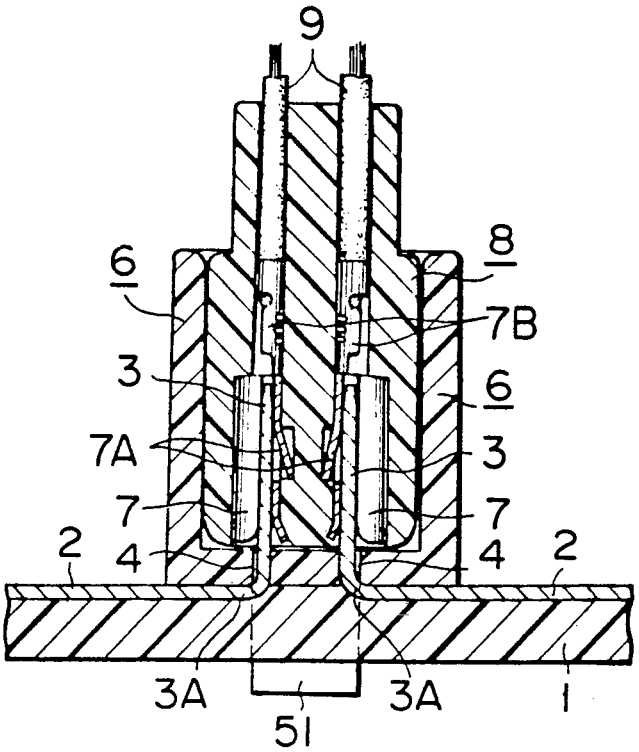
FIGS. 8A and 8B are vertical sectional views of the first and the second embodiments, taken at different planes from the vertical sectional views in FIGS. 5A and 5B.

Referring to FIGS. 1A and 2A, the first embodiment of the electrical connector device of the present invention has electrical connector device of the present invention has the following parts: elongated narrow metal conductor plates 2 provided by, for example, embedding on one side of an insulating base 1 made of plastic, the conductor plates 2 being bent upward at, for example, their ends so as provide upwardly projecting conductor strips 3, a tubular insulating member 6 made of heat-resistant plastic such as 66 nylon having a bottom provided with apertures 4 for receiving the conductor strips 3 as shown in FIGS. 2A and 7A, the tubular insulating member 6 sides thereof capable of engaging with, for example, lower edges 11A of an aperture 11B of insulating base 1 as shown in FIGS. 3A and 4A; and a heat-resistant male engaging member 8 having female connector members 7 made of a resilient metallic sheet and adapted to fit on the conductor strips 3; wherein the base portions 3A of the conductor strips 3 are clamped between the portions of the lower surface of the bottom of the tubular insulating member 6 around the apertures 4 and the surface of the insulating base 1, as shown in FIGS. 4A, 7A and 8A. In these Figures, numeral 11B denotes the aperture formed in the insulating base so as to provide edges 11A for retaining hooks 51A of the resilient tabs 51. Numeral 7A denotes a retaining claw for retaining the female connecting member 7 in the male engaging member 8 in a manner shown in FIG. 7A. Numeral 9 denotes lead lines which are covered with insulating sheathes and electrically connected to the female connecting member 7 at fitting portioned to the female connecting members 7 at fitting portions 7B as shown in FIGS. 2A and 7A. Numerals 6A and 8A denote, respectively, a projection and recess which are formed on the tubular insulating member 6 and the male engaging member in a manner shown in FIG. 3A, for the purpose of ensuring insertion of the male engaging member in correct orientation. The tubular insulating member 6 with the bottom can have a circular cross-section though it is illustrated to have a rectangular cross-section in the drawings. The male engaging member 8 also can have a cylindrical hollow structure correspondingly. In the illustrated embodiment, there are two narrow conductor tabs 3. This, however, is only illustrative and the invention can be carried out with only one conductor plate 2 and one conductor strip 3, or two, three or more conductor plates and corresponding number of conductor strips as shown in FIGS. 10 to 13.

In such cases, the number of the female connector members 7, as well as the constructions of the male engaging member 8 and the tubular insulating member 6 are suitably determined in conformity with the number of the conductor strips. In the arrangements shown in FIGS. 10 to 13, it is not necessary to form an aperture such as the aperture 11B. Namely, inwardly facing hooks 51A, 51A of the resilient tabs 51, 51 can engage with the side edges 11A, 11A of the base 1 so that the tubular insulating member can be fastened to protrude upright from the base 1. The assembly procedure is as follows.

The insulating base 1, the tubular insulating member 6 and the male engaging member 8 are first separated from one another as shown in FIGS. 1A and 2A. Then, the tubular insulating member 6 is lowered with its resilient tabs 51 sliding along the wall of the aperture 11B in the insulating base 1 into engagement with the lower edges 11A, as shown in FIGS. 3A and 4A. Thus, the resilient tabs 51 are deflected inwardly due to the tapered outer surfaces of the hook portions 51A, 51A thereof and, when the hooks 51A,51A have passed the aperture 11B, the resilient tabs 51 are released to expand outward, thus attaining a snap fit of the hook portions 51A, 51A on the lower edges 11A, 11A around the aperture 11B in the insulating base 1.

It is thus possible to fasten the tubular insulating member in a single snapping action. In this state, the base portions 3A of the conductor strips 3 upwardly bent from BUS bars 2 are strongly clamped between the upper surface of the insulating base 1 and the lower surface of the bottom of the tubular insulating member 6 around the apertures 4, as a result of the engagement between the resilient tabs 51 of the tubular insulating member 6 and the edges 11A of the insulating base 1, so that unintentional deformation or displacement of the conductor strips 3 is prevented despite application of an external force which is exerted when, for example, the female connector members 7 are brought into or out of contact with the conductor strips. It will be seen that, in this state, the narrow conductor plates, i.e., BUS bars 2, are electrically connected to an external circuit through the conductor strips 3 integral therewith, the female connector members 7 and the lead lines 9.

A second embodiment of the invention will be described with reference to the drawings.

Figure 1B:
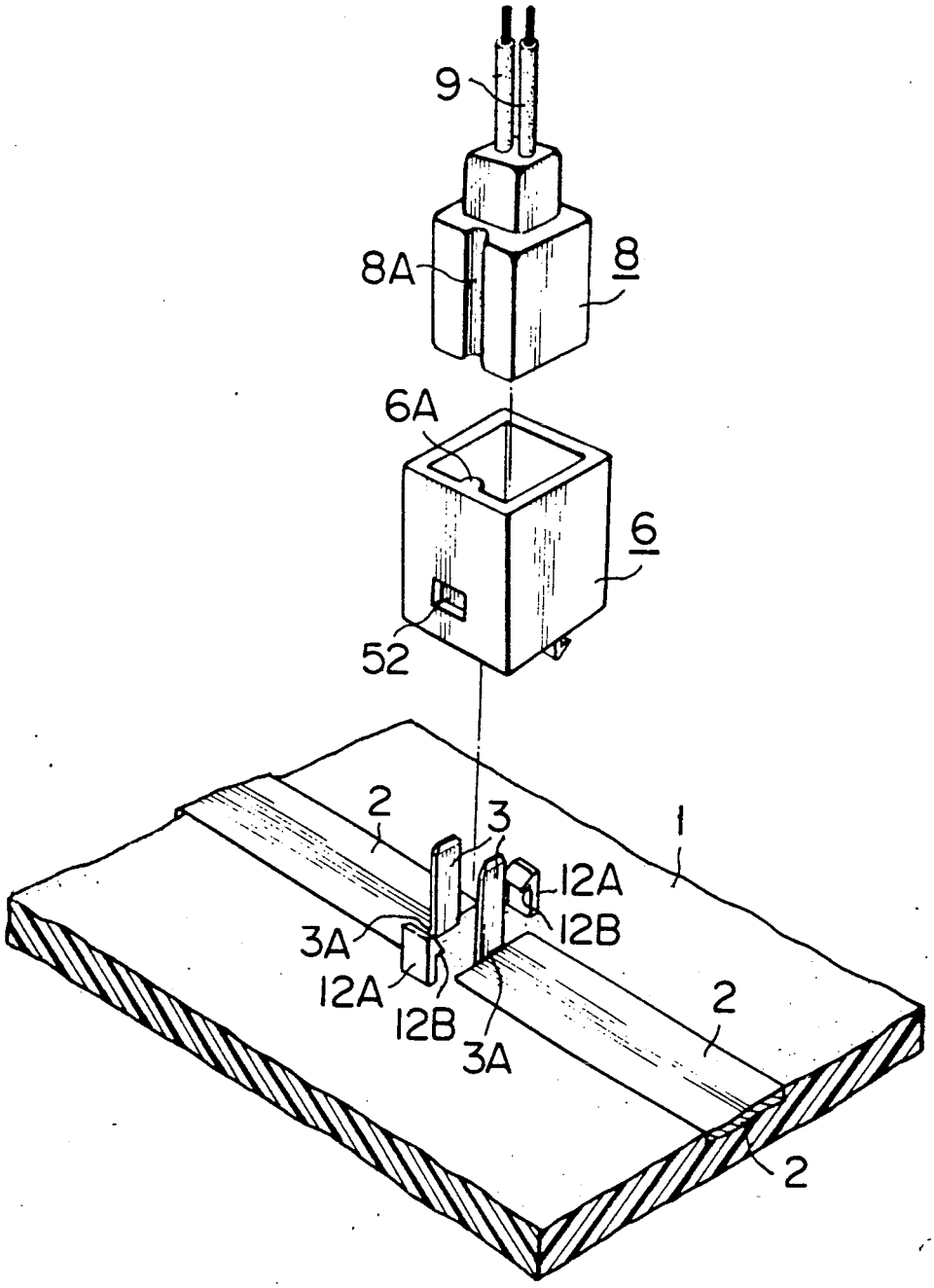
Figure 3B:
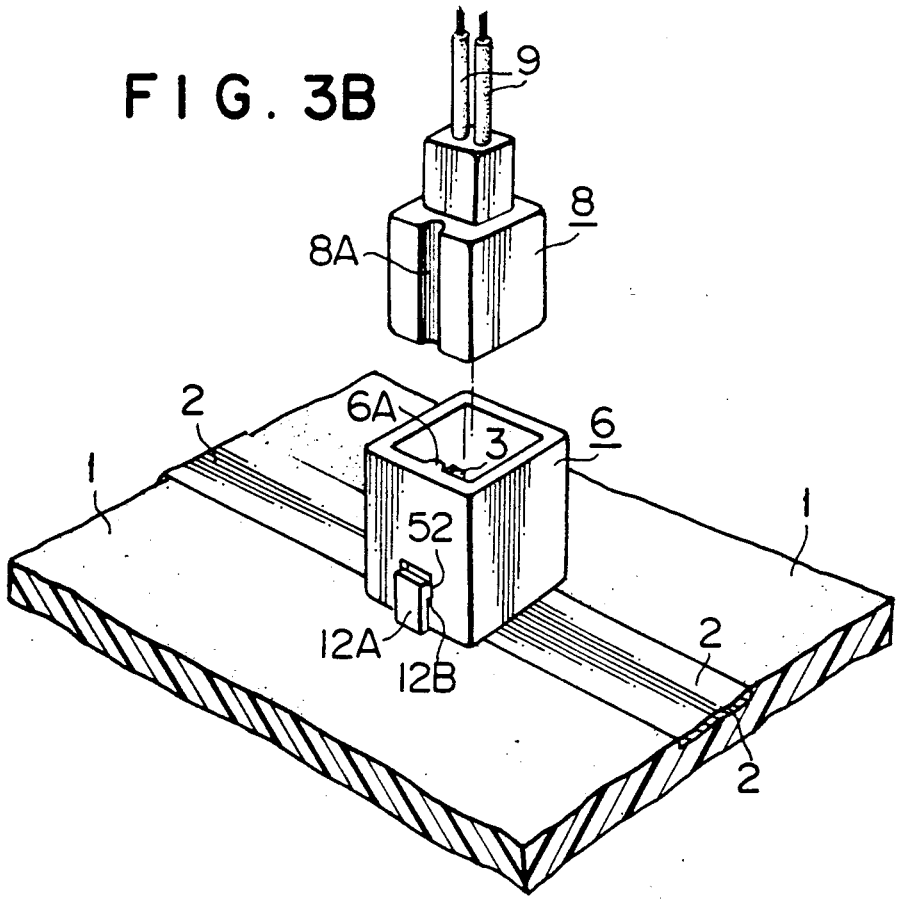
Figure 6A:
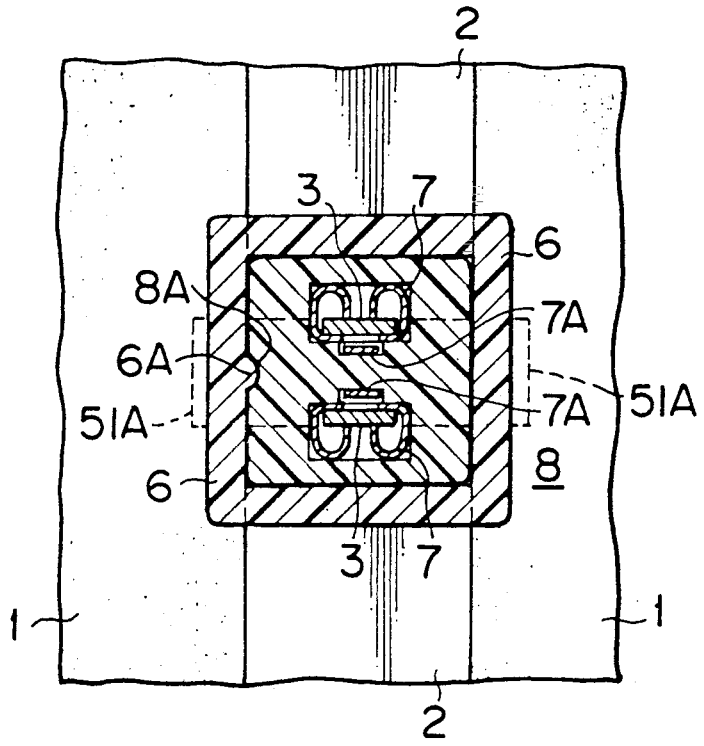
FIGS. 6A and 6B are cross-sectional views taken along the lines A—A of FIGS. 5A and 5B, respectively.
Figure 6B:
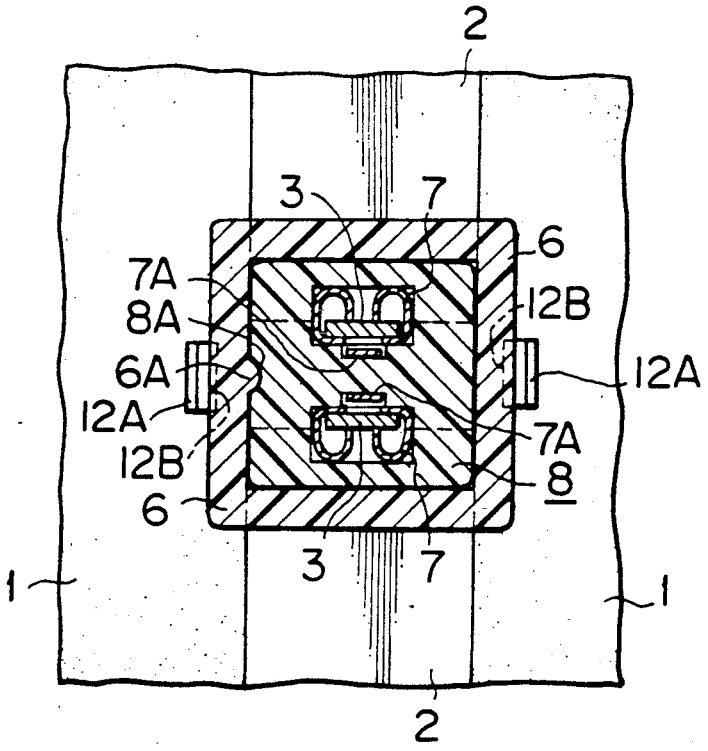
Figure 8B:
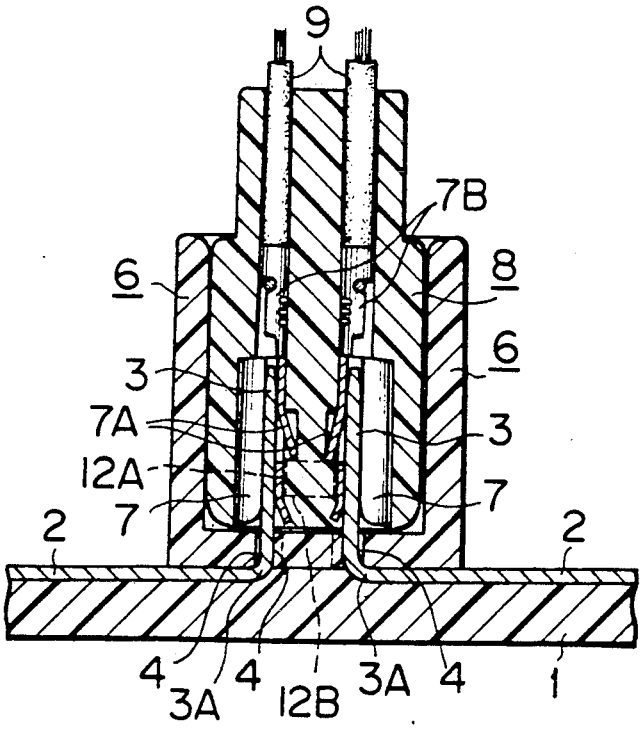

The second embodiment of the electrical connector device comprises the following parts, as shown in FIGS. 1B and 2B: elongated narrow metal conductor plates 2 provided by, for example, embedding on one side of an insulating base 1 made of plastic, the conductor plates 2 being bent upward at, for example, their ends so as provide upwardly projecting conductor strips 3, the insulating base having resilient tabs 12A, 12A projecting upward therefrom; a tubular insulating member 6 having a bottom provided with apertures 4 for receiving the conductor strips 3 as shown in FIGS. 2B and 7B, the tubular insulating member 6 also having retaining steps 52, 52 capable of retaining the resilient tabs 12A, 12A of the insulating base 1 as shown in FIGS. 3B and 4B; and male engaging member 8 having female connector members 7 made of resilient metal sheets and adapted to fit on the conductor strips as shown in FIGS. 5B and 6B; wherein the base portions 3A of the conductor strips 3 are clamped between the portions of the lower surface of the bottom of the tubular insulating member 6 around the apertures 4 and the surface of the insulating base 1, as shown in FIGS. 4B, 7B and 8B. In these Figures, numeral 7A denotes a retaining claw for retaining the female connecting member 7 in the male engaging member 8 in a manner shown in FIG. 7B.

Figure 9A:
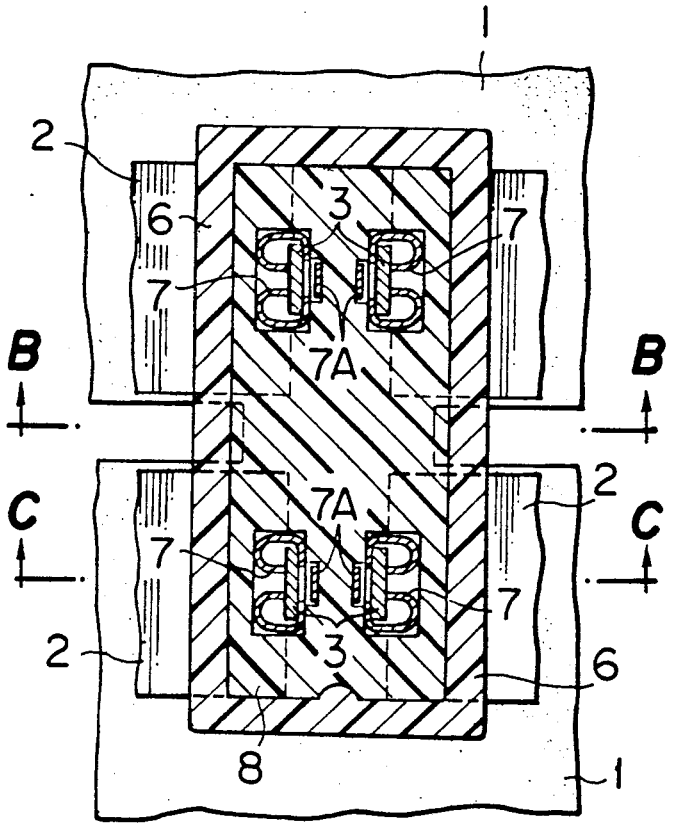
FIG. 9A is a cross-sectional view of a different embodiment.
Figure 9B:
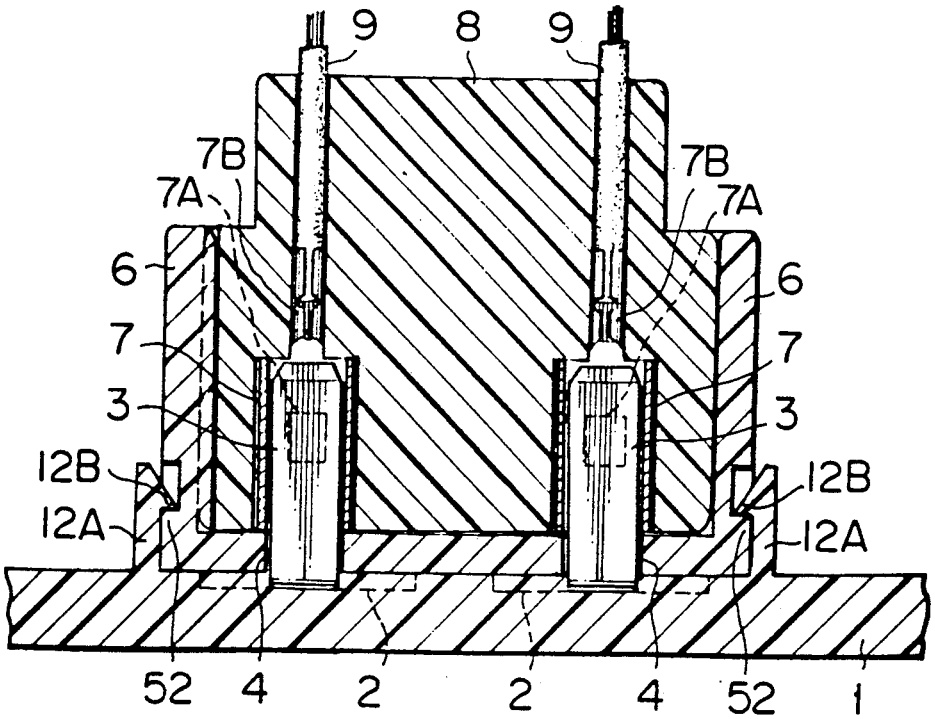
FIG. 9B is a vertical sectional views of the embodiment shown in FIG. 9A.
Figure 10:
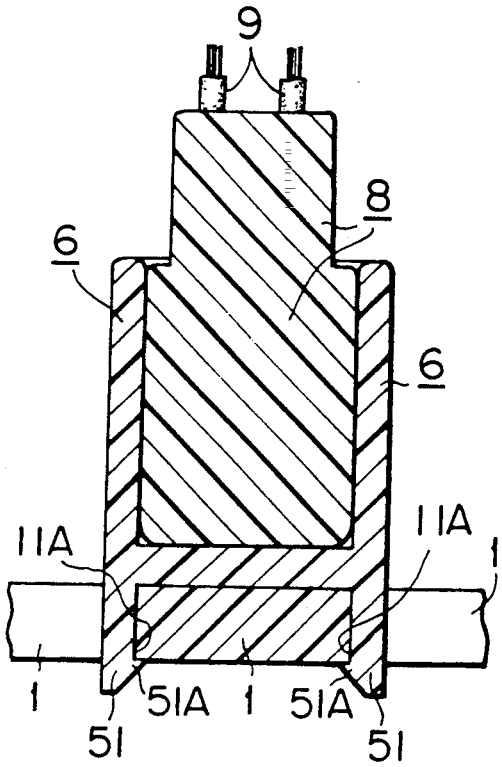
FIGS. 10 and 11 are vertical sectional views taken along the lines B—B and C—C of FIG. 9A.
Figure 11:
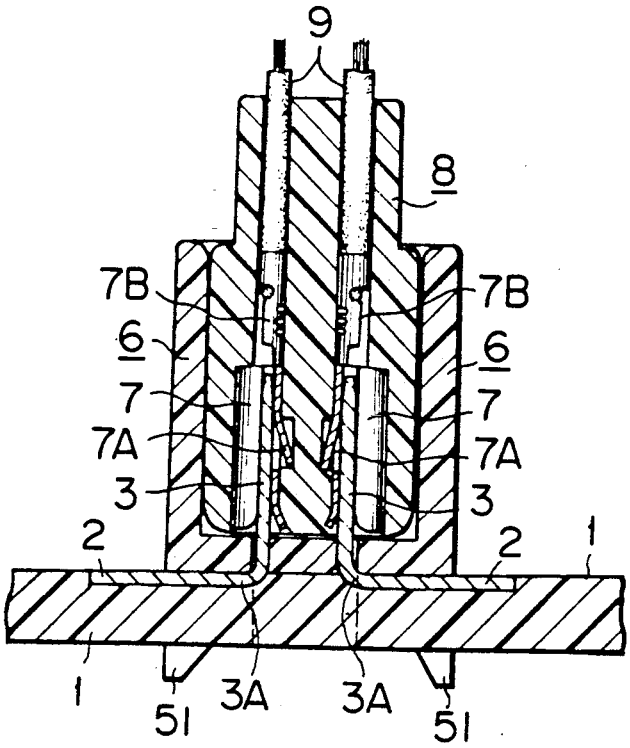
Figure 12:
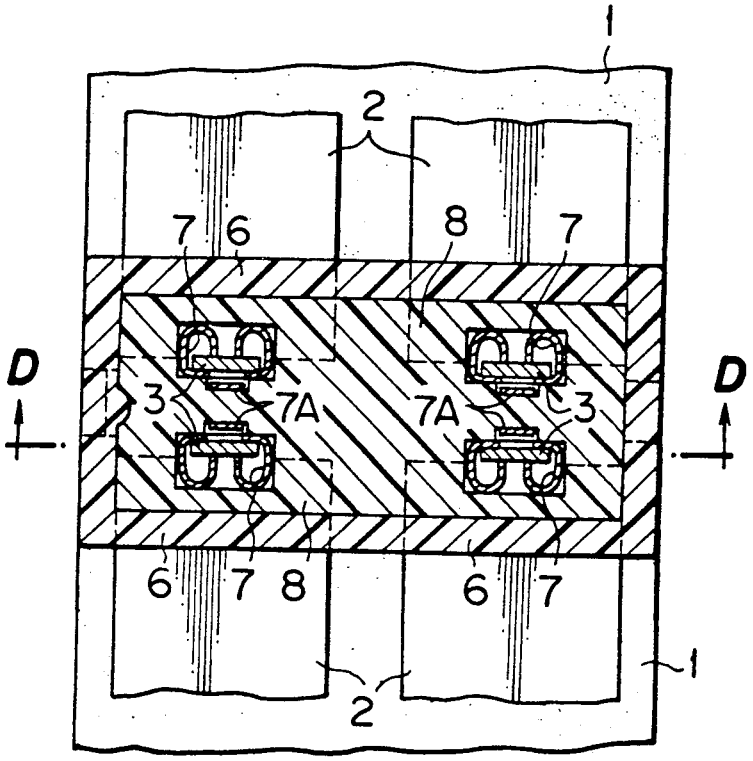
FIG. 12 is horizontal sectional views of a different embodiment.
Figure 13:
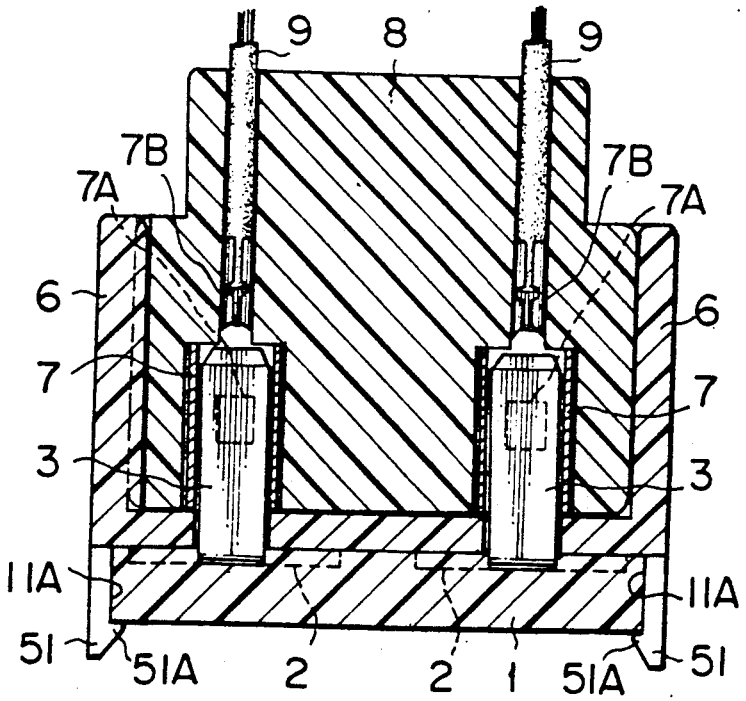
FIG. 13 is a vertical sectional views taken along the line D—D of FIG. 12.

Numeral 9A denotes lead lines which are covered with insulating sheathes and electrically connected to the female connecting members 7 at fitting portions 7B as shown in FIGS. 2B and 7A. Numerals 6A and 8A denote, respectively, a projection and recess which are formed on the tubular insulating member 6 and the male engaging member in a manner shown in FIG. 3B, for the purpose of ensuring insertion of the male engaging member in correct orientation. The tubular insulating member 6 with the bottom can have a circular cross-section though it is illustrated to have a rectangular cross-section in the drawings. The male engaging member 8 also can have a cylindrical hollow structure correspondingly. In the illustrated embodiment, there are two narrow conductor plates 2 and, hence, two upwardly projecting conductor tabs 3. This, however, is only illustrative and the invention can be carried out with only one conductor plate 2 and one conductor strip 3, or two, three or more conductor plates and corresponding number of conductor strips as shown in FIGS. 9B. In such cases, the number of the female connector members 7, as well as the constructions of the male engaging member 8 and the tubular insulating member 6 are suitably determined in conformity with the number of the conductor strips, as shown in FIG. 9B.

The assembly procedure is as follows.

The insulating base 1, the tubular insulating member 6 and the male engaging member 8 are first separated from one another as shown in FIGS. 1B and 2B. Then, the tubular insulating member 6 is lowered towards the resilient tabs 12A, 12A from the upper side of the insulating base 1, keeping the retaining steps 52, 52 in alignment with the resilient tabs 12A, 12A. Thus, the resilient tabs 12A, 12A are deflected inwardly due to the tapered outer surfaces of the hook portions thereof and, thereafter, the resilient tabs 12A, 12A are released to expand outward, thus attaining a snap fit of the hook portions 12B, 12B of the resilient tabs 12A, 12A on the retaining steps 52, 52 on the tubular member 6. It is thus possible to fasten the tubular insulating member 6 in a single snapping action. In this state, the base portions 3A of the conductor strips 3 upwardly bent from BUS bars 2 are strongly clamped between the upper surface of the insulating base 1 and the lower surface of the bottom of the tubular insulating member 6 around the apertures 4, as a result of the engagement between the resilient tabs 12A, 12A and the retaining steps 52, 52 on the tubular insulating member 6, conductor strips 3 is prevented despite application of an external force which is exerted when, for example, the female connector members 7 are brought into or out of contact with the conductor strips. It will be seen that, in this state, the narrow conductor plates, i.e., BUS bars 2, are electrically connected to an external circuit through the conductor strips 3 integral therewith, the female connector members 7 and the lead lines 9.

As will be understood from the foregoing description, the present invention offers the following advantages.

In the assembly of the electrical connector device of the first embodiment, the tubular insulating member 6 is lowered with its resilient tabs 51 sliding along the walls of the aperture 11B in the insulating base 1 into engagement with the lower edges 11A so that the resilient tabs 51 are deflected inwardly due to the tapered outer surfaces thereof and are then released to expand outward, thus attaining a snap fit of the hook portions 51A, 51A on the lower edges 11A, 11A of the insulating base 1, whereby the tubular insulating member 6 can be fastened to the insulating base 1 by a single snapping action. Thus, the fixing of the tubular insulating member can be conducted without requiring laborious works such as driving of screws with a screw driver and without requiring any additional part such as a cover plate. Thus, the assembly can easily be conducted even in the dark or a restricted place, thus contributing to a reduction in the cost. In addition, the base portions 3A of the conductor strips 3 upwardly bent from BUS bars 2 are strongly clamped between the upper surface of the insulating base 1 and the lower surface of the bottom of the tubular insulating member 6 around the apertures 4, as a result of the engagement between the resilient tabs 51 on the tubular insulating member 6 and the edges 11A of the insulating base 1, so that unintentional deformation or displacement of the conductor strips 3 is prevented despite application of an external force which is exerted when, for example, the female connector members 7 are brought into or out of contact with the conductor strips.

Referring now to the second embodiment, in the assembly of the electrical connector device, the tubular insulating member 6 is lowered towards the resilient tabs 12A, 12A from the upper side of the insulating base 1, keeping the retaining steps 52, 52 in alignment with the resilient tabs 12A, 12A, so that the resilient tabs 12A, 12A are deflected inwardly due to the tapered outer surfaces of the hook portions thereof and, thereafter, the resilient tabs 12A, 12A are released to expand outward, thus attaining a snap fit of the hook portions 12B, 12B of the resilient tabs 12A, 12A on the retaining steps 52, 52 on the tubular member 6, whereby the tubular insulating member can be fastened by a single snapping action. In this state, the base portions 3A of the conductor strips 3 upwardly bent from BUS bars 2 are strongly clamped between the upper surface of the insulating base 1 and the lower surface of the bottom of the tubular insulating member 6 around the apertures 4, as a result of the engagement between the resilient tabs 12A, 12A and the retaining steps 52, 52 on the tubular insulating member 6. Thus, the second embodiment offers the same advantages as those produced by the first embodiment.

What is claimed is:

1. An electrical connector device comprising:

a base member made of an electrically insulating plastics material;

at least one pair of opposingly oriented elongated narrow conductor plates each having a base portion embedded within one surface of said electrically insulating base so as to be coextensive with said one base surface, each said base portion of said conductor plates terminating in an upwardly bent end portion so as to provide an upwardly projecting electrically conductive strip, wherein said conductive strips of said conductor plates are in opposed relationship to one another;

a tubular insulating member having a bottom surface provided with apertures for receiving said conductor strips, said tubular insulating member also having resilient tabs capable of engaging with lower edges of said insulating base; and a male engaging member having female connector members adapted to fit on said conductor strips; wherein the embedded base portions of said conductor strips are forcibly clamped between said bottom surface of said tubular insulating member around said apertures and the surface of said insulating base.

2. An electrical connector device comprising:

a base member made of an electrically insulating plastics material and having resilient tabs projecting upwardly from one surface thereof;

at least one pair of opposingly oriented elongated narrow conductor plates each having a base portion embedded within said one surface of said electrically insulating base so as to be coextensive with said one base surface, each said base portion of said conductor plates terminating in an upwardly bent end portion so as to provide an upwardly projecting electrically conductive strips, wherein said conductive strips of said conductor plates are in opposed relationship to one another;

a tubular insulating member having a bottom surface provided with apertures for receiving said conductor strips, said tubular insulating member also having retaining steps capable of retaining said resilient tabs of said insulating base; and a male engaging member having female connector members adapted to fit on said conductor strips; wherein the embedded base portions of said conductor strips are forcibly clamped between said bottom surface of said tubular insulating member around said apertures and the surface of said insulating base.

3. An electrical connector device comprising:

an electrically insulative base member;

at least one electrically conductive bus bar strip embedded within one surface of said base member so as to be coextensive with said one base member surface;

said bus bar strips terminating in an upwardly bent portion thereby establishing an electrically conductive male terminal which projects upwardly from said one base surface;

an electrically insulative tubular member having a planar bottom wall which defines at least one aperture through which said upwardly projecting male terminal extends; and coupling means for coupling said tubular member to said base member;

said embedded bus bar strips are forcibly clamped int the vicinity of said upwardly projecting male terminal between said bottom wall of said tubular member and said base member when said tubular member and said base member are coupled to one another by said coupling means to thereby minimize deformation of said male terminal.

4. An electrical connector device as in claim 3, wherein said coupling means includes a male engagement part formed on one of said tubular member and said insulating base, and a female recess adapted to receive said male engagement part formed on the other of said tubular member and said insulating base.

5. An electrical connector as in claim 3, wherein a pair of bus bar strips are embedded within said surface of said base member, each said bus bar strip terminating in a respective upwardly projecting male terminal extending through a respective aperture formed in the bottom wall of said tubular member.

* * * * *